US005207195A

United States Patent [19]

McClintic

[11] Patent Number: 5,207,195

[45] Date of Patent: May 4, 1993

[54] COMBINED STARTER CONVERSION AND OIL FILTER ADAPTER

[75] Inventor: John W. McClintic, Albuquerque, N. Mex.

[73] Assignee: McClintic RDM, Inc., Albuquerque, N. Mex.

[21] Appl. No.: 921,202

[22] Filed: Jul. 29, 1992

[51] Int. Cl.[5] ..... F01M 11/03; F02N 15/00

[52] U.S. Cl. ..... 123/179.25; 123/195 A; 123/196 A

[58] Field of Search ..... 123/179.25, 196 R, 196 A, 123/179.1, 195 A, DIG. 1, DIG. 7, 195 C

[56] References Cited

U.S. PATENT DOCUMENTS

| | | | |
|---|---|---|---|
| 1,215,568 | 2/1917 | Mills | 123/179.25 |
| 2,035,124 | 3/1936 | Good | 123/179 |
| 2,041,541 | 5/1936 | Good | 290/38 |
| 2,945,484 | 7/1960 | Scherenberg et al. | 123/179 |
| 4,155,266 | 5/1979 | Bradley | 123/195 A |
| 4,270,497 | 6/1981 | Valerio | 123/195 C |
| 4,492,632 | 1/1985 | Mattson | 123/196 A |
| 4,519,348 | 5/1985 | Hamilton | 123/195 C |
| 4,955,343 | 9/1990 | Ogami | 123/195 R |

*Primary Examiner*—Andrew M. Dolinar
*Attorney, Agent, or Firm*—Jacobson, Price, Holman & Stern

[57] ABSTRACT

An L-shaped mounting bracket is provided having first and second flange portions with the first flange portion designed for removable seated mounting from the left rear oil filter mounting pad location of a corporate GM motor block and the second flange portion being designed for rigid removable mounting of a high torque engine starter motor therefrom. The relocation of the starter motor the right rear portion of the motor block to the left rear portion of the motor block enabling the oil pan of the engine in the right rear corner thereof to be considerably laterally outwardly expanded.

7 Claims, 2 Drawing Sheets

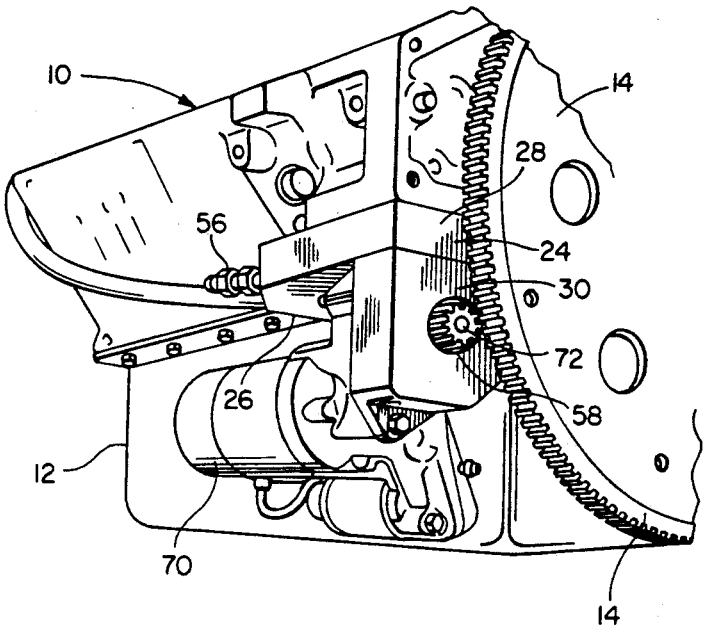
FIG. 1
FIG. 2
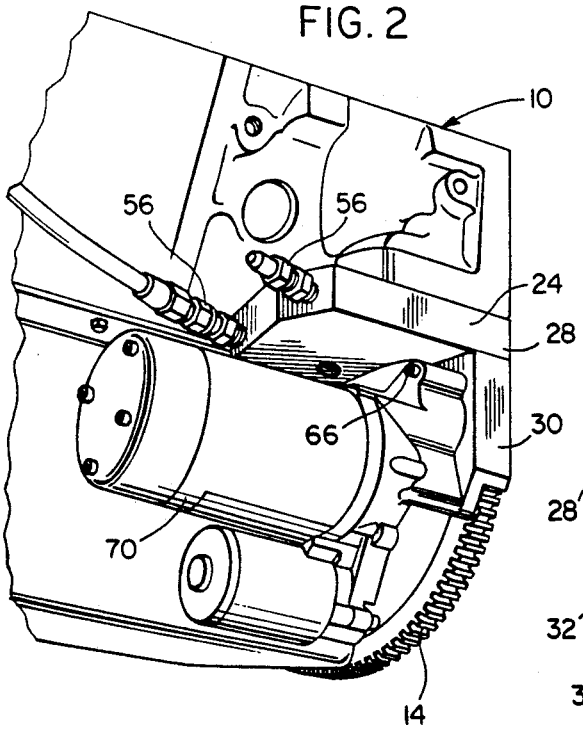
FIG. 3
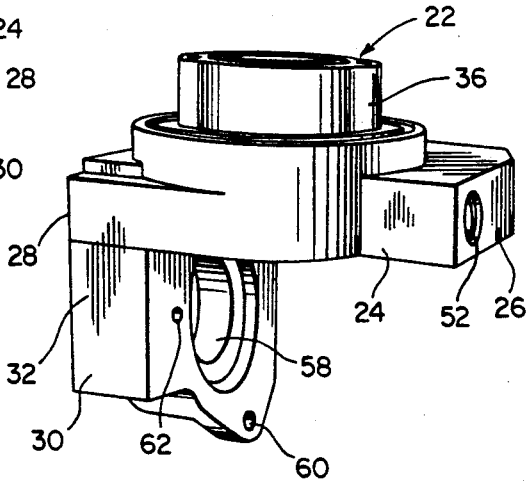

COMBINED STARTER CONVERSION AND OIL FILTER ADAPTER

BACKGROUND OF THE INVENTION

1. Field of the Invention

This invention relates to an adapter by which the right hand or passenger side mounted starter motor at the rear of a Chevrolet or similar GM corporate block motor may be remounted at the rear of the left hand or driver's side of the block from the oil filter mounting pad location of the block. The adapter may or may not include integral oil passages for use with a remote oil filter and the remounting of the starter motor on the left hand side of the block does away with an obstruction (the starter motor mounted in the old mounting location thereof) which heretofore has prevented lateral outward enlargement of the right side and rear right corner of the oil pan mounted to the block.

2. Description of Related Art

Various different methods have been utilized for providing additional lubricating oil capacity for modified automobile or truck racing engines originally designed for personal and commercial usage. The oil pans have been increased in depth and also laterally expanded in order to increase the internal volume thereof. In addition, windage trays also have been used in an attempt to lessen the amount of lubricating oil which rises in the rear or side portions of an oil pan responsive to acceleration and cornering forces, which rising lubricating oil may be impacted by the counterweights and connecting rod lower ends of the associated crankshaft resulting in a reduction of maximum power output. In addition, when the counterweights of the crankshaft and connecting rod lower ends impact with and swing through such rising oil, foaming of the lubricating oil occurs with an attendant loss in lubricating efficiency when such foaming oil passes through an oil pump and is subsequently directed to internal bearing surfaces of the engine.

It has been estimated and measured that impact of the crankshaft counterweights and connecting rod lower ends with rising oil in the associated oil pan can result in a loss of 20 or more horsepower in a modified racing engine and the period during which oil rises in the right rear corner of the oil pans of modified racing engines occurs when the associated race car is accelerating out of a left hand turn (all turns being left handed in oval racing).

This oil buildup in the right rear corner (passenger side) also occurs during hard straight line acceleration, but not as violently as does occur when turning left and accelerating at the same time. Additionally, elevated oil temperatures are also eliminated by the crankshaft not swinging through and frictionally engaging the oil in the oil reservoir of the oil pan. This friction, occurring by the rotating mass coming in contact with the oil reservoir (which moves to different locations in the oil pump by the centrifugal forces generated by acceleration, turning etc.), can elevate temperatures in excess of 40 F degrees. Another advantage by the isolation of the rotating mass from the lubricating fluids, is the non-aeration of the oil or the ingestion of lubricant having air entrained therein by the lubricating system of the engine.

Of course, if a loss of 20 horsepower or more at the point at which a race car is exiting a turn or under hard acceleration can be eliminated, that race car has a considerable advantage over other race cars not having such an advantage.

The adapter of the instant invention is specifically designed to enable relocation of the right hand mounted starter motor of an engine to the left hand side of the engine, thereby eliminating an obstruction to lateral outward enlargement of the rear right hand corner and entire right hand side of the associated oil pan. By enlarging considerably the right side and the right rear corner of an engine oil pan, not only is the internal volume of the oil pan appreciably increased in order to reduce the operating temperature of the lubricating oil, but oil within the oil pan is provided with an area into which the oil may be forced by centrifugal and acceleration forces when the associated race car is exiting a left hand turn. By providing this additional internal volume to the oil pan at the right side and right rear corner thereof, oil within the oil pan under centrifugal and acceleration forces does not rise in an area immediately beneath the crankshaft of the engine and, therefore, the associated crankshaft counterweights and connecting rod lower ends do not impact with and swing through standing oil within the oil pan.

Examples of windage tray constructions, left side mounted starter motors and starter motor modifications for operative association with other engine modifications are disclosed in U.S. Pat. Nos. 2,035,124, 2,041,541, 2,945,484, 4,270,497, 4,519,348 and 4,955,343. However, these previously known devices do not include an adapter by which a conventional right hand mounted starter motor may be remounted from the oil filter mounting pad location on the left side of a motor.

SUMMARY OF THE INVENTION

The adapter of the instant invention comprises a mounting bracket incorporating a first horizontal flange portion having front and rear ends and a second vertical flange portion rigidly dependingly supported from the rear end of the horizontal flange portion. The horizontal flange portion includes a stepped upwardly directed boss which is upwardly seatingly receivable within the stepped downwardly opening cavity of a Chevrolet or other GM corporate engine block at the rear left corner thereof originally designed as an oil filter pad mounting location and threaded bolts are provided for mounting the horizontal flange in a rigid manner from the oil filter pad mounting location. In addition, the depending flange has a stepped access opening formed therethrough and means for supporting a starter motor therefrom with the starter motor spur gear projecting through the access opening into position in operative association with the left hand periphery of the toothed flywheel of the engine.

The main object of this invention is to provide an adapter for remounting the conventional right side mounted starter motor of a Chevrolet or other GM corporate engine block to the left side of the block to thereby enable the rear right side portion of the oil pan of the block to be considerably laterally outwardly enlarged.

Another object of this invention is to provide an adapter in accordance with the preceding object and which also may be utilized to provide sealed communication between the engine block outlet and inlet oil passages and a remotely mounted oil filter.

Still another object of this invention is to provide an adapter in accordance with the preceding objects which may be readily modified to accept starter motors of different manufacture.

A final object of this invention to be specifically enumerated herein is to provide a starter motor remounting adapter in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a fragmentary perspective view of the left rear corner of a Chevrolet V-8 engine block illustrating the adapter of the instant invention supporting a high torque after market starter motor from the left rear corner of the engine block in operative association with the left hand periphery of the flywheel of the engine;

FIG. 2 is a further fragmentary perspective view of the assemblage illustrated in FIG. 1 as seen from the forward left hand side thereof and more clearly illustrating the remote oil filter inlet and outlet nipples provided on the adapter;

FIG. 3 is a perspective view of the adapter as seen from the forward right hand side thereof;

DESCRIPTION OF THE PREFERRED EMBODIMENT

Figure 4:
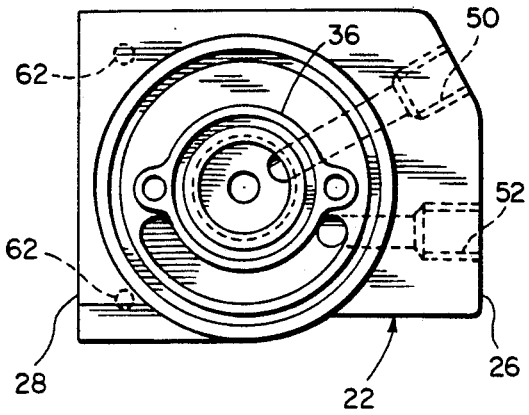
FIG. 4 is a top view of the adapter.

Referring now more specifically to the drawings the numeral 10 generally designates a conventional V-8 engine block having an oil pan 12 removably mounted to the underside thereof. The block 10 has a rear, toothed flywheel 14 mounted on the rear end of the crankshaft (not shown) thereof and the reference numeral 16 generally designates the rear, right hand starter mounting location while the reference numeral 18 generally designates the left rear oil filter pad mounting location. The oil filter pad mounting location includes an oil inlet passage 20 for receiving return oil from the usually associated oil filter (not shown) and an oil outlet area 22 by which the usually associated oil filter receives oil under pressure from the engine block 10.

The foregoing comprises a description of a conventional automotive/truck V-8 engine block sold through the various motor car divisions of General Motors Corporation.

Conventional engine blocks of many different manufacturers are modified for racing, and in particular for "oval racing" wherein the racing cars are "setup" for straight line racing and left turn racing.

When a racing car is accelerating out of a left hand turn onto a straight section of a racetrack, the quantity of oil within the oil pan 12 is directed toward the right rear corner of the oil pan 12. As the level of oil within the right rear and along the right side of the oil pan rises, the counterweights of the crankshaft and the lower ends of the connecting rods impact with and swing through the elevated oil with the result that in excess of 20 potential horsepower may be lost as the race car is accelerating out of a left hand turn and onto a straight section of the racetrack.

Accordingly, inasmuch as greater acceleration out of a turn comprises one of the most desirable aspects of a racing car, various attempts have been made to lessen the elevation of engine oil within an oil pan in the region of the interior of the oil pan through which the crankshaft counterweights and connecting rod lower ends swing.

In addition, when crankshaft counterweights and the lower ends of connecting rods impact with and swing through elevated oil within an associated oil pan, the oil has considerable quantities of air introduced thereinto and if oil having air entrained therein is pumped through the oil pump of the engine and subsequently directed toward various bearing surfaces of the engine, the lubricating capacity of the oil is substantially reduced, often time leading to premature bearing failure. Accordingly, a second reason exists for preventing crankshaft counterweights and connecting rod lower ends from impacting with elevated engine oil within an associated oil pan.

In order to reduce interference between crankshaft counterweights and connecting rod lower ends with oil in an engine oil pan, the lower portion of oil pans are conventionally increased in volume, thereby reducing the elevation of oil within the pan along the right side and at the rear end thereof during acceleration out of left hand turn. However, even when enlarged oil pans are utilized such interference still exists to the extent that in excess of 20 horsepower may be lost.

In order to completely or substantially eliminate interference between crankshaft counterweights and connecting rod lower ends with oil within an oil pan as a race car accelerates out of a left hand turn, it has been found that considerable lateral outward enlargement of the rear right hand corner portion of the oil pan will at least substantially eliminate crankshaft counterweight and connecting rod impact with engine oil. However, the right rear corner of GM corporate V-8 engine blocks conventionally are provided with rear right hand mounted starter motors and the rear right hand corner portions of the corresponding oil pans cannot be effectively enlarged because of interference with the starter motors. Accordingly, the adapter of the instant invention, referred to in general by the reference numeral 24, has been designed as a mount for relocating the starter motor from the rear right hand corner of the engine block 10 to the rear left hand corner area of the engine block provided with a downwardly opening stepped recess 34 defining the oil filter pad mounting location 18.

The adapter 22 comprises a horizontal flange 24 having front and rear ends 26 and 28 and a vertical flange 30 whose upper end 32 is rigidly removably mounted to the rear end of the horizontal flange 24.

The horizontal flange 24 includes a stepped, upwardly projecting boss 36 snugly upwardly receivable within the stepped recess 34 and the flange 24 is secured in position through the utilization of a center bolt 38 and a pair of diametrically opposite radially outwardly positioned bolts 40, the boss 36 including small and large diameter 0-rings 42 and 44 sealingly engagable with the center and outer peripheral portions 46 and 48 of the recess 34.

The horizontal flange 24 includes an inlet oil passage 50 formed therein opening outwardly of the forward end of the horizontal flange 26 and an outlet oil passage 52 formed therein also opening outwardly of the forward end 26 of the horizontal flange 24. The inlet oil passage 50 opens inwardly into the oil inlet passage 20 and the passage 52 opens into the oil outlet area 22. The ends of the passage 50 and 52 opening outwardly of the forward end of the horizontal flange 24 have oil line nipples 56 operatively associated therewith by which a remote mounted oil filter (not shown) may be disposed in fluid sealed communication with the passages 50 and 52 and thus the inlet passage 20 and the oil outlet area 22.

Usually, the oil filter pad mount location 18 has an oil filter pad mount supported therefrom through the utilization of fasteners corresponding to the fasteners 38 and 40 and a "spin-on" on oil filter is operatively associated therewith. However, when utilizing the adapter 22 of the instant invention, the oil filter pad mount is not utilized.

The vertical flange 30 has a stepped access opening 58 formed therethrough as well as a through bore 60. In addition, a pair of threaded blind bores 62 are provided in the horizontal flange and are utilized to receive fasteners 64 and 66 therein by which the rear stepped end 68 of a high torque starter motor 70 is mounted from the flange 30, the starter motor being equipped with a spur gear 72 projected through opening 58 and disposed in operative association with the left side of the toothed outer periphery 76 of the flywheel 14.

The starter motor 70 may be the same high torque starter motor which is usually mounted from the conventional starter mounting location 16 through utilization of a suitable bracket (not shown) provided therefore and it will be appreciated that the starter motor 76, in its remounted location, turns in the same direction that a conventionally mounted starter motor turns.

If it is desired, the passages 50 and 52 may be omitted and the block 10 may otherwise be provided with an oil filter. However, and especially since many racing engines utilizing conventionally mounted starters are equipped with remote mounted oil filters, in most cases the adapter 22 will be provided with the oil passages 50 and 52.

Figure 5:
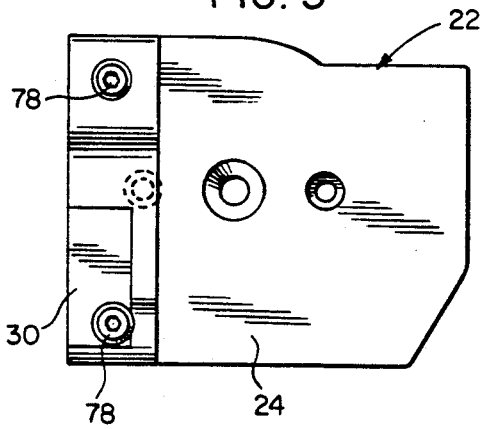
FIG. 5 is a bottom plan view of the adapter.
Figure 6:
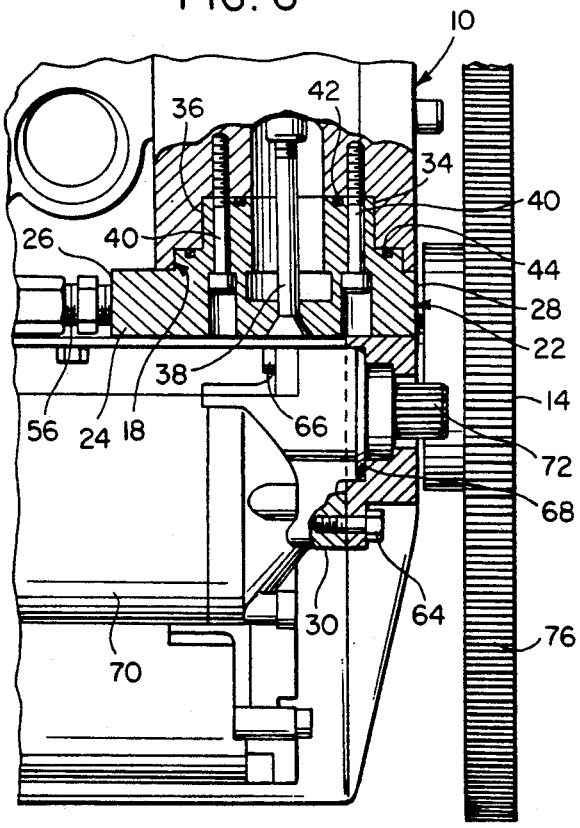
FIG. 6 is a left side elevational view of the assemblage illustrated in FIGS. 1 and 2 with the adapter and closely associated portions of the engine block and starter motor being broken away and illustrated in vertical section.
Figure 7:
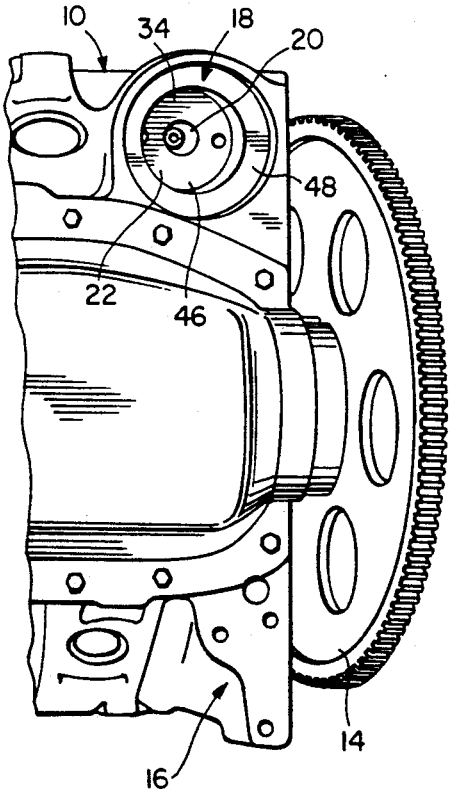
FIG. 7 is a fragmentary bottom perspective view of a typical Chevrolet V-8 engine block illustrating the oil filter pad mounting location at the left rear corner of the block in the upper right hand corner of FIG. 7.

As may be seen from FIG. 5, the vertical flange 30 is removably mounted to the horizontal flange 24 through the utilization of mounting bolts 78 secured upwardly through the vertical flange 30. Furthermore, it will be noted from FIG. 6 of the drawings that the horizontal flange 24 is first secured to the engine block 10 through the utilization of the bolts 38 and 40 and that the vertical flange 30 is then secured to the horizontal flange 24 by the bolts 78, the vertical flange 30 preventing access to the rear bolt 40 after securement of the vertical flange 30 to the horizontal flange 24.

The oil pan 12, inasmuch as the starter motor 70 has been remounted from the right side of the engine block 10 to the left side thereof, is considerably laterally outwardly enlarged in any convenient manner (not shown) not only to provide considerable additional internal volume to the oil pan 12, but to also provide considerable internal oil pan volume displaced appreciably to the right of the center line of the engine block 10. This considerable additional internal volume of the oil pan 12 allows the oil within the pan immediately beneath the crankshaft to actually be lowered during a left hand turn and acceleration out of a left hand turn so as to totally eliminate impact of the crankshaft counterweights and connecting rod lower ends with oil standing in the oil pan. Of course, the lateral outward enlargement of the right hand side of the oil pan 12 is not so great as to allow centrifugal force, when executing a left hand turn, to starve the engine oil pump (not shown).

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

WHAT IS CLAIMED AS NEW IS AS FOLLOWS:

1. In combination with a motor block having a rear oil filter mounting pad location on one side and a rear starter motor mounting location on the opposite side, a starter mounting conversion adapter including first and second mounting portions rigidly positioned relative to each other, first means removably rigidly mounting said first mounting portion to said oil filter mounting pad location, an engine starter motor, second means removably mounting said engine starter motor to said second mounting portion, said motor block including a toothed flywheel spanning between said mounting locations, said starter motor, when removably mounted to said second mounting portion, being mounted in operative association with said flywheel for turning the latter when said starter motor is actuated.

2. The motor block and adapter combination of claim 1 wherein said one side comprises the left side of the motor block as viewed from the rear thereof.

3. In combination with a motor block having a rear oil filter mounting pad location on one side, a rear starter motor mounting location on the other side and a rear toothed flywheel, a starter mounting conversion adapter including a first horizontal mounting flange portion having front and rear ends, said oil filter mounting location defining a downwardly opening recess, said first horizontal mounting flange portion including an upwardly directed boss snugly receivable within said recess closing the latter from below, means removably rigidly mounting said first mounting flange portion from said block with said boss closing said recess from below, said adapter also including a vertical flange portion rigid with and depending from the rear end of said horizontal flange portion and defining an access passage therethrough in a front-to-rear direction, said passage defining a forwardly facing seat, and a starter motor assembly removably mounted from said vertical flange portion and including a shouldered end seated against said seat, said starter motor assembly including a spur gear projected through said access passage and disposed for operative association with said toothed flywheel.

4. The combination of claim 3 wherein said motor block defines engine lubricating oil inlet and return passages opening into said recess, said horizontal flange portion including a pair of separate oil transfer passages formed therein each including a first end opening horizontally outwardly of said horizontal flange portion and a second end sealingly communicated with a corresponding block lubricating oil passage.

5. The combination of claim 3 wherein said horizontal and vertical flange portions are separately formed and are removably rigidly joined.

6. The method of providing additional rear, right side oil pan clearance for an engine block conventionally having a starter motor mounted immediately outward of the rear of the right side of the engine oil pan in operative association with the right side periphery of the engine flywheel and an oil filter mounting pad location immediately outward of the rear of the left side of the engine block oil pan, said method including providing a starter motor mounting adapter having a first mounting portion and a second mounting portion, removably mounting said adapter first mounting portion from said oil filter pad mounting location in fluid tight sealed engagement therewith and removably mounting said starter motor to said second mounting portion in operative association with the left side periphery of said flywheel.

7. The method claim 6 wherein said engine block includes engine lubricating oil return and outlet passages opening outwardly therefrom in said oil filter mounting pad location, said method including providing said first mounting portion with first and second oil transfer passages disposed in sealed communication with said oil return and outlet passages and with said transfer passages opening outward of said first mounting portion for communication with a remote mounted oil filter.

* * * * *